US005152831A

United States Patent [19]

Yamaguchi et al.

[11] Patent Number: 5,152,831

[45] Date of Patent: Oct. 6, 1992

[54] METHOD OF PRODUCING ULTRA-LOW-CARBON STEEL

[75] Inventors: Koji Yamaguchi; Yasuo Kishimoto; Toshikazu Sakuraya; Masaru Washio; Kazuhisa Hamagami; Hiroshi Nishikawa, all of Chiba, Japan

[73] Assignee: Kawasaki Steel Corporation, Kobe, Japan

[21] Appl. No.: 767,984

[22] Filed: Sep. 30, 1991

[30] Foreign Application Priority Data

Jun. 27. 1991 [JP] Japan ..... 3-156755

[51] Int. Cl.[5] ..... C21C 7/10

[52] U.S. Cl. ..... 75/512; 75/511

[58] Field of Search ..... 75/511, 512

[56] References Cited

U.S. PATENT DOCUMENTS

| | | | |
|---|---|---|---|
| 3,337,329 | 8/1967 | Finkl | 75/512 |
| 4,071,356 | 1/1978 | Yamamoto | 75/512 |
| 5,011,531 | 4/1991 | Takahashi | 75/511 |

*Primary Examiner*—Peter D. Rosenberg

*Attorney, Agent, or Firm*—Dvorak and Traub

[57] ABSTRACT

A method of producing an ultra-low-carbon steel by using a vacuum degasser on a molten steel has the steps of conducting vacuum decarburization to attain a predetermined level of carbon content, e.g., 25 ppm or below, in the molten steel while progressively reducing the pressure in said vacuum degasser, conducting addition of hydrogen in which hydrogen is dissolved in said molten steel while said pressure is temporarily elevated to 20 Torr or above, and conducting final decarburization after reducing said pressure to 2 Torr or below. The addition of hydrogen may be conducted to meet the following conditions:

$$[H] \geqq \{([C]-[C]final)/5\}+4$$

wherein [H] represents the hydrogen content (ppm) in said molten steel in the state after the addition of hydrogen, [C] represents the carbon content (ppm) in the molten steel in the state after the addition of hydrogen, and [C] final represents the final carbon content (ppm) to be obtained.

10 Claims, 6 Drawing Sheets

METHOD OF PRODUCING ULTRA-LOW-CARBON STEEL

BACKGROUND OF THE INVENTION

1. FIELD OF THE INVENTION

The present invention relates to a method of producing an ultra-low-carbon steel through a vacuum decarburization process. More particularly, the present invention is concerned with a method of producing an ultra-low-carbon steel in which non-deoxidized or weakly-deoxidized molten steel prepared by a steel making furnace, particularly a combined blowing converter or an LD converter, is decarburized by a vacuum degasser, whereby an ultra-low-carbon steel having a carbon concentration less than 10 ppm can be produced quickly without impeding operation of a vacuum degassing plant.

2. DESCRIPTION OF THE RELATED ART

A continuous annealing apparatus, which has become available in recent years, has created a remarkable increase in the productivity of cold-rolled steel strip. This continuous annealing system has given a rise to the demand for an ultra-low-carbon steel having a carbon content of 10 ppm or less.

Conventionally, an ultra-low-carbon steel has been produced by a process in which a molten steel, which has been decarburized in a converter down to 0.02 to 0.05 wt% in terms of carbon content, is exposed to a low pressure atmosphere in a vacuum degasser such as a RH degasser so that carbon is extracted as CO gas. With this known method relying upon a vacuum degasser, however, it has been difficult to produce an ultra-low-carbon steel having a carbon content [C] less than 10 ppm in an industrial scale, because the decarburization rate is drastically decreased when the carbon content [C] is reduced to a level less than 50 ppm.

In order to accelerate the decarburization rate in such low carbon region, it has been considered significant to increase the area of the reaction site. With this knowledge, it has been attempted to enhance the reaction rate by increasing the area of the reaction site. Gas bubbles in molten steel, or surface of the molten steel in a vacuum chamber, or splash metal in the vacuum chamber is considered reaction site. Thus far, the extent of contribution of each of such reaction sites to the reaction has not been definitely determined. Under these circumstances, a method employing blowing of Ar gas into molten steel in an RH vacuum chamber at a large rate of 5 $Nm^3$/min or so has been used with a view that an increase in the flow rate of Ar as agitating or recirculating gas would contribute to promotion of decarburization reaction.

Blowing of Ar gas at such a large rate, however, causes a problem in that the degasser cannot operate continuously due to deposition of splash metal to the inner surface of the vacuum chamber of the vacuum degasser as a result of vigorous generation of splash metal caused by the blowing of Ar gas.

In order to obviate the above-described problem, a method has been proposed and used in which hydrogen gas or a hydrogen-containing gas is blown into a molten steel so as to increase the content of hydrogen dissolved in the molten steel [H]. According to this method, a reaction expressed by $2H \rightarrow H_2$ takes place to generate bubbles of hydrogen gas so as to enhance the effect of agitation and to increase the decarburization rate by the increase in the area of the reaction sites. This method is disclosed in Japanese Patent Laid-Open No. 57-194206.

It has been confirmed that this method can increase the decarburization rate in the low-carbon region and, hence, contributes to improvement in the efficiency of production of ultra-low-carbon steel. This method, however, requires that the hydrogen content is maintained at a sufficiently high level, e.g., 3 to 5 ppm, in order to provide an appreciable effect in promoting decarburization. To maintain such a high hydrogen content, it has been required that hydrogen is blown at a rate not smaller than 2.5 $Nm^3$/min, when an RH degasser having a capacity of, for example, 250 tons is used.

For the sake of effective production of ultra-low-carbon steel, the pressure in the vacuum chamber is generally reduced to less than 2 Torr. On the other hand, the reduction in the pressure in the vacuum chamber leads to a significant promotion of dehydrogenation reaction, making it difficult to maintain the hydrogen content at a considerably high level.

Thus, the known process of employing an RH conventional vacuum degasser requires an impracticably long time, e.g., 30 to 40 minutes or longer, of decarburization for reducing the carbon content to a level below 10 ppm, even when the recirculation velocity is increased for the purpose of accelerating the decarburization reaction.

SUMMARY OF THE INVENTION

Accordingly, an object of the present invention is to overcome the problems and industrial difficulties encountered in the above-described method of blowing hydrogen gas to produce an ultra-low-carbon steel.

Another object of the present invention is to enable production of an ultra-low-carbon steel having a carbon content [C] not more than 10 ppm in an industrial scale.

Still another object of the present invention is to provide practical means of supplying hydrogen, as well as operation conditions, which enables achievement of the above-described objects of the invention.

To these ends, according to one aspect of the present invention, there is provided a method of producing an ultra-low-carbon steel by using a vacuum degasser on a molten steel, comprising the steps of conducting vacuum decarburization to attain a predetermined level of carbon content, e.g., 25 ppm or below, in the molten steel by progressively reducing the pressure in said vacuum degasser, adding hydrogen which is dissolved in said molten steel while said pressure is temporarily elevated to 20 Torr or above, and conducting final decarburization by reducing said pressure to 2 Torr or below. Preferably, hydrogen is added to meet the following conditions:

$$[H] \geqq \{([C]-[C]\text{final})/5\} + 4 \quad \ldots\ldots \quad (1)$$

wherein [H] represents the hydrogen content (ppm) in said molten steel in the state after the addition of hydrogen, [C] represents the carbon content (ppm) in the molten steel in the state after the addition of hydrogen, and [C] final represents the final carbon content (ppm) to be obtained.

The above and other objects, features and advantages of the present invention will become evident from the following description of the preferred embodiment taken in conjunction with the accompanying drawings.

DESCRIPTION OF THE PREFERRED EMBODIMENTS

In the conventional process in which a hydrogen-containing substance is supplied during vacuum decarburization, the decarburization reaction and dehydrogenation reaction take place simultaneously. In order to maintain the hydrogen content high enough to effectively promote decarburization, therefore, it has been necessary to add hydrogen at a large rate. The present inventors have found, however, a sufficiently large decarburization promotion effect can be obtained when a hydrogen concentration higher than a predetermined level is obtained while the carbon content falls within a predetermined range, so that it is unnecessary to maintain a high hydrogen content for a long time. Keeping a high hydrogen content during vacuum degassing is not easy with ordinary equipment which can provide only a limited rate of addition of hydrogen. However, a rise of the hydrogen content by suspending the vacuum degassing can be realized without difficulty even with existing equipment which provides a comparatively low rate of hydrogen injection.

According to the invention, the pressure in the vacuum chamber is increased to suppress the degassing reaction at a suitable time during decarburization and, hydrogen is added while the degassing reaction is suppressed, so as to optimumly control the carbon and hydrogen contents. Then, the pressure in the vacuum chamber is reduced again to activate the degassing reaction, whereby the decarburization is promoted effectively. The hydrogen content tentatively rises when hydrogen is added but is drastically lowered when the pressure in the vacuum chamber is reduced again. The hydrogen content is reduced to 2.5 ppm or so within 5 minutes after the reduction in the pressure. Meanwhile, the carbon content in the molten steel does not show any substantial change during the operation of adding hydrogen, but it is drastically lowered in a period of 5 minutes or so at the beginning of the period of final decarburization conducted after the addition of hydrogen. The decarburization effect, however, progressively decreases in accordance with the reduction in the hydrogen content. When the hydrogen content is lowered to 2.5 ppm or so, the decarburization rate also is reduced almost to the same level as that in the conventional processes.

Figure 4:
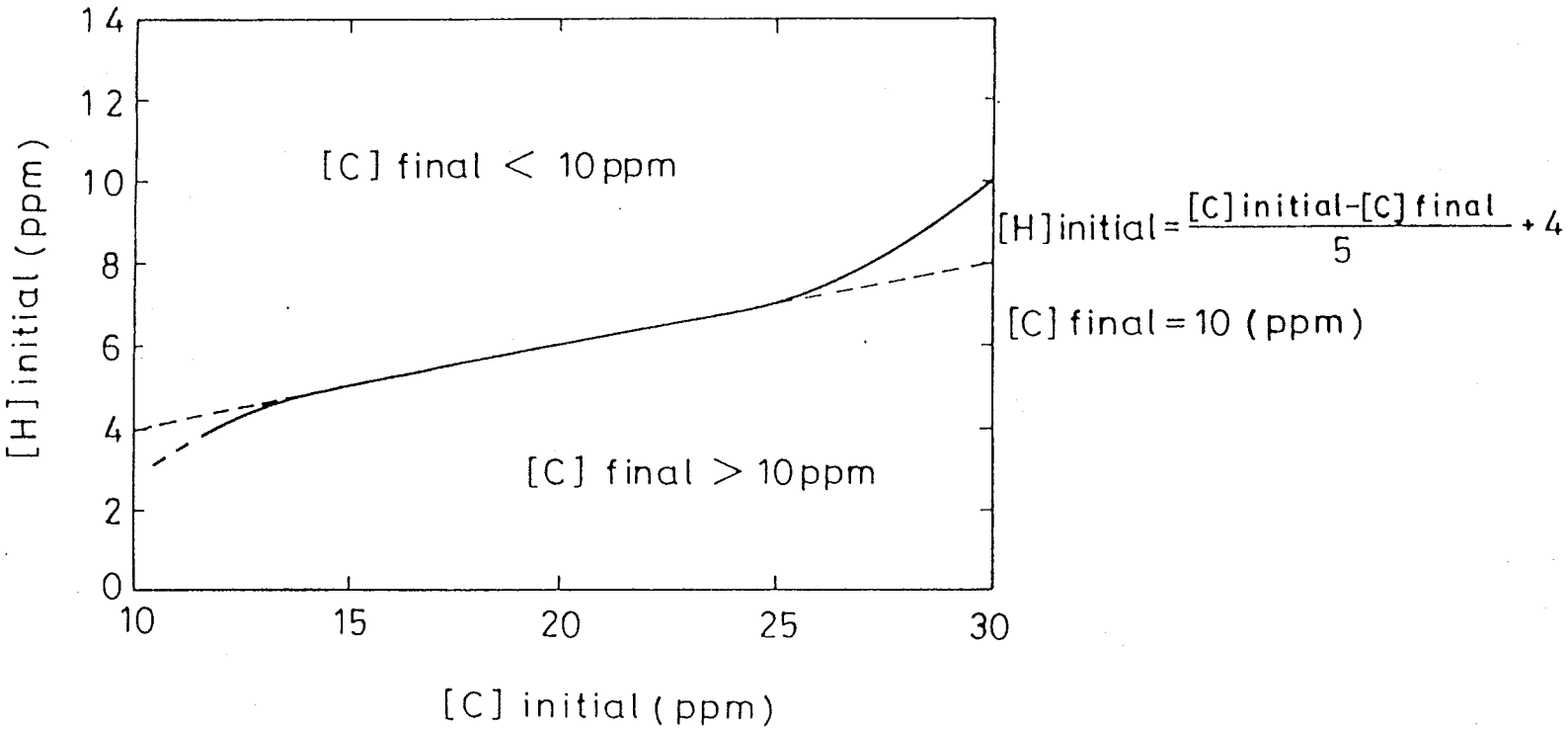
FIG. 4 is a graph showing ranges of carbon and hydrogen contents in a molten steel after addition of hydrogen but before final decarburization, the optimum being to attain an ultra low-carbon content of less than 10 ppm in the steel.

FIG. 4 shows the optimum ranges of carbon content [C] initial and hydrogen content [H] initial which are to be attained at the beginning of the final decarburization for the purpose of enabling decarburization down to 10 ppm or below in terms of carbon content within the period in which the hydrogen content decreases down below 2.5 ppm after the start of the final decarburization. Decarburization down to 10 ppm or less in terms of the carbon content is possible when the hydrogen content and carbon content are determined above the respective curves in FIG. 4. The carbon content [C] initial and the hydrogen content [H] initial, however, can be determined freely in consideration of the decarburization rate and the rate of addition of hydrogen, so as to minimize the total process time.

From FIG. 4, it will be understood that addition of hydrogen in the presence of more than 25 ppm of carbon is not preferred from the view point of efficiency and time of addition of hydrogen, because an impractically large hydrogen content is required to compensate for reduction in the effect of addition of hydrogen.

The decarburization rate is reduced drastically when the carbon content is decreased beyond about 25 ppm when an ordinary vacuum degasser is used. According to the present invention, therefore, it is preferred that the addition of hydrogen is conducted after the carbon content has been reduced to 25 ppm or below.

The values of the carbon content [C]initial and the hydrogen content [H]initial shown in FIG. 4 are for attaining a final carbon content [C]final of 10 ppm. It will be seen that a prompt decarburization down to any desired target or final carbon content [C]final can be effected when the hydrogen content [H]initial is determined to meet the condition of the formula (1) shown before, and whenever the carbon content [C]initial and the hydrogen content [H]initial fall within the preferred ranges shown in FIG. 4.

In order to shorten the total process time, it is also necessary to shorten the period of addition of hydrogen. This can be attained in the method of the present invention in which the internal pressure of the vacuum chamber is elevated during addition of hydrogen so as to suppress de-hydrogenation reaction and to promote dissolving of hydrogen into the molten steel.

According to the method of the present invention, non-deoxidized or weakly-deoxidized molten steel is vacuum-decarburized through an RH process, a DH process or a VOD process.

Figure 1:
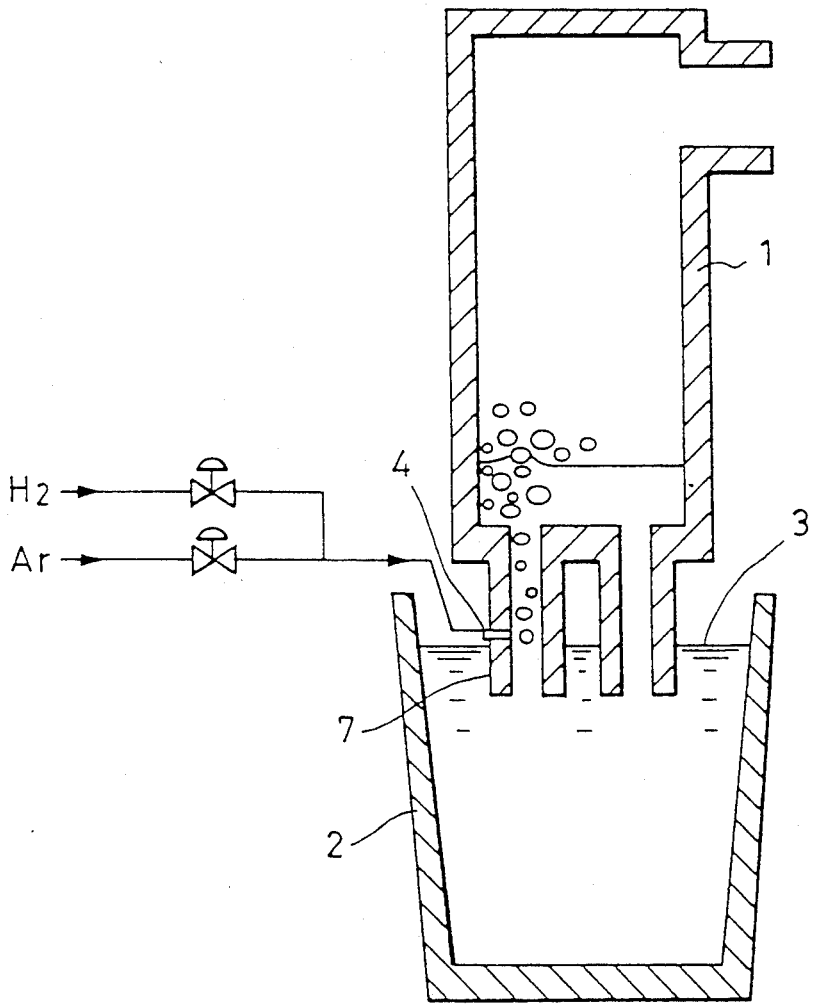
FIGS. 1 to 3 are schematic sectional views of an RH degasser which can suitably be employed in carrying out the method of the present invention.

FIG. 1 is a schematic sectional view of an RH vacuum degasser suitable for use in carrying out the method of the present invention. The degasser has a vacuum chamber 1, a ladle 2, and a recirculation gas tuyere 4 provided in the wall of an up-leg 7. Numeral 3 denotes a molten steel.

Figure 5:
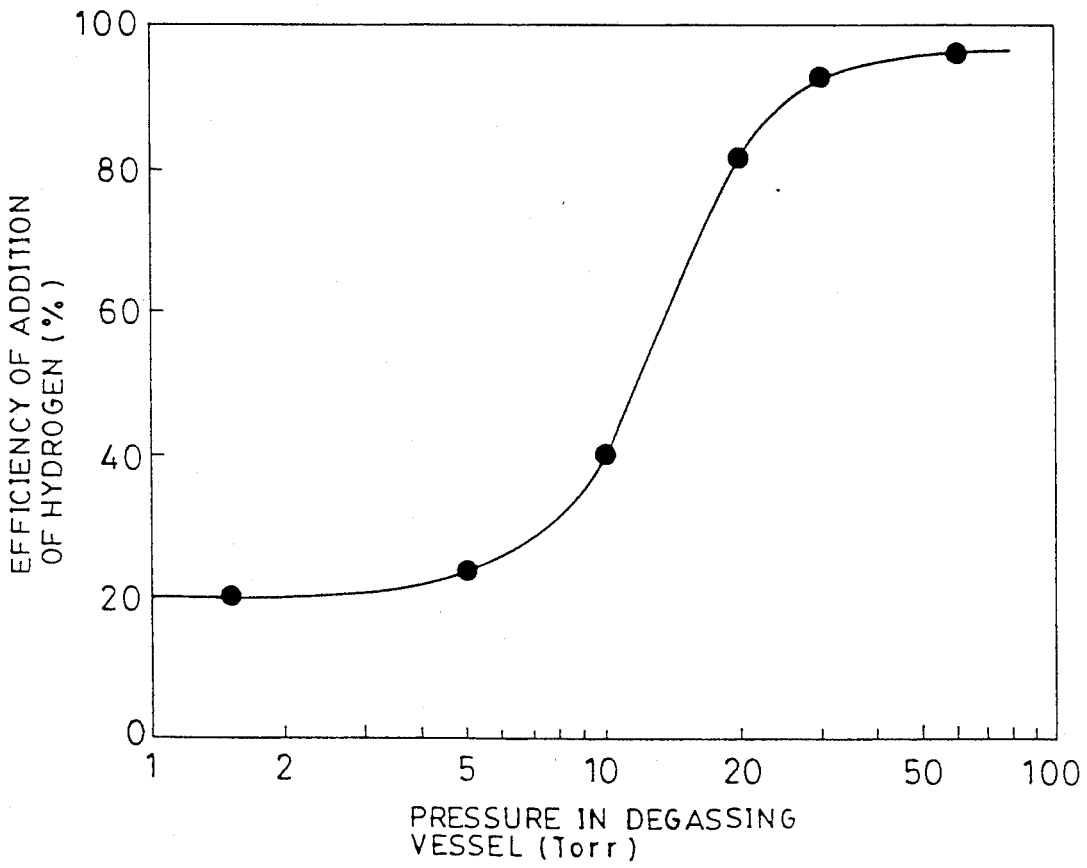
FIG. 5 is a graph showing the relationship between pressure in a vacuum chamber and hydrogen dissolving efficiency as observed when hydrogen gas is blown through a recirculation gas tuyere opening in an up-leg of an RH degasser.

FIG. 5 is a graph showing the relationship between the pressure inside the vacuum chamber and the efficiency of dissolution of hydrogen gas as observed in a 250-ton scale RH degasser of the type shown in FIG. 1 when $H_2$ and Ar gases are blown into the molten steel at rates of 6.0 $Nm^3$/min and 1.0 $Nm^3$/min, respectively, through the recirculation gas tuyere 4 in the up-leg 7. The hydrogen content is in the range from 3 ppm to 7 ppm in this case. Conventional processes could not provide sufficiently high level of hydrogen content because of too small efficiency of dissolution of hydrogen, although they could provide hydrogen gas into the up-leg 7 at considerably large rate. In contrast, the method of the present invention allows hydrogen to be dissolved at a high efficiency even when the hydrogen is introduced at a large rate into the up-leg, and on condition that the pressure in the vacuum chamber is maintained at 20 Torr or above.

Figure 6:
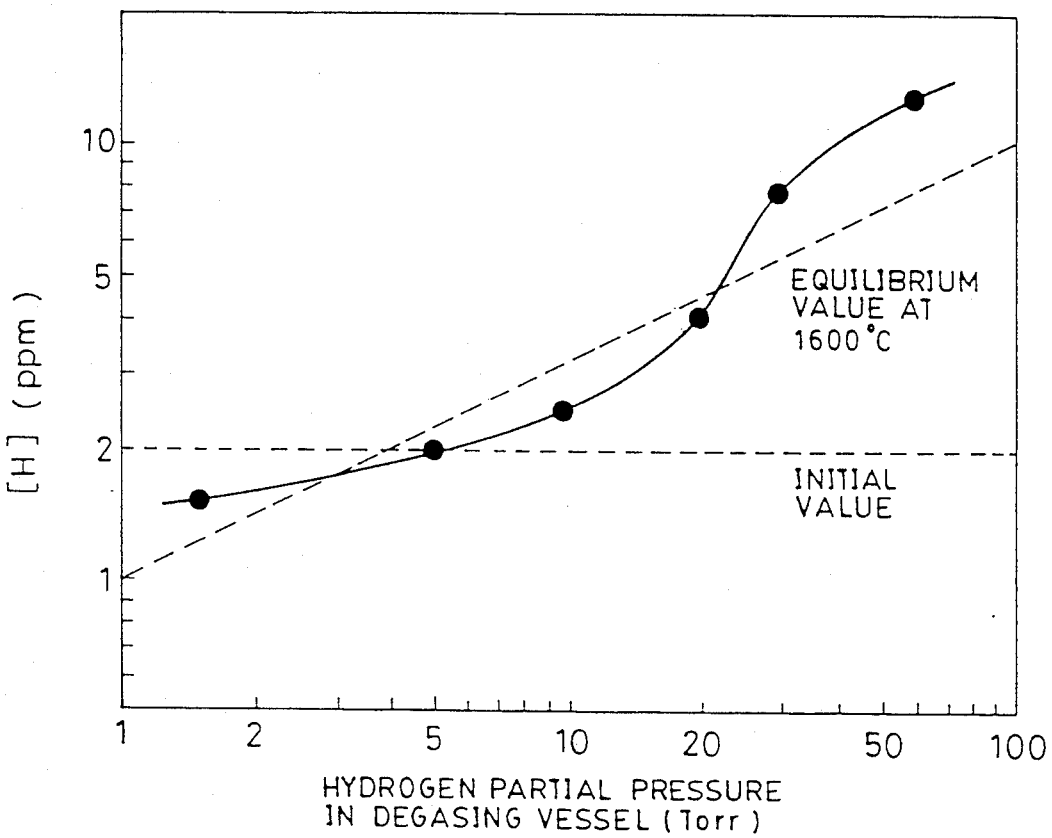
FIG. 6 is a graph showing the relationship between pressure in a vacuum chamber and hydrogen dissolving efficiency as observed when hydrogen gas is supplied by top blowing into a vacuum chamber.

FIG. 6 shows the relationship between the internal pressure of the vacuum chamber of a 250-ton scale RH degasser and the hydrogen content of a molten steel in the vessel as observed 5 minutes after the beginning of supply of hydrogen to the molten steel by top blowing from a top blowing lance which is set 2.0 m above the melt surface, the blowing being conducted at a rate of 10 $Nm^3$/min while the initial hydrogen content of the molten steel is about 2 ppm. FIG. 6 also shows the relationship between the hydrogen partial pressure and the equilibrium hydrogen content at 1600° C.

From these facts, it is understood that, in order to efficiently add hydrogen to a molten steel and to increase the hydrogen content to a required level, it is effective to elevate the internal pressure of the vessel to 20 Torr or above before the hydrogen gas is supplied. However, for enhancing the efficiency of decarburization reaction during the final decarburization, i.e., final decarburization, conducted after the addition of hydrogen, it is necessary to reduce the internal pressure of the vacuum chamber down to 2 Torr or below.

Figure 2:
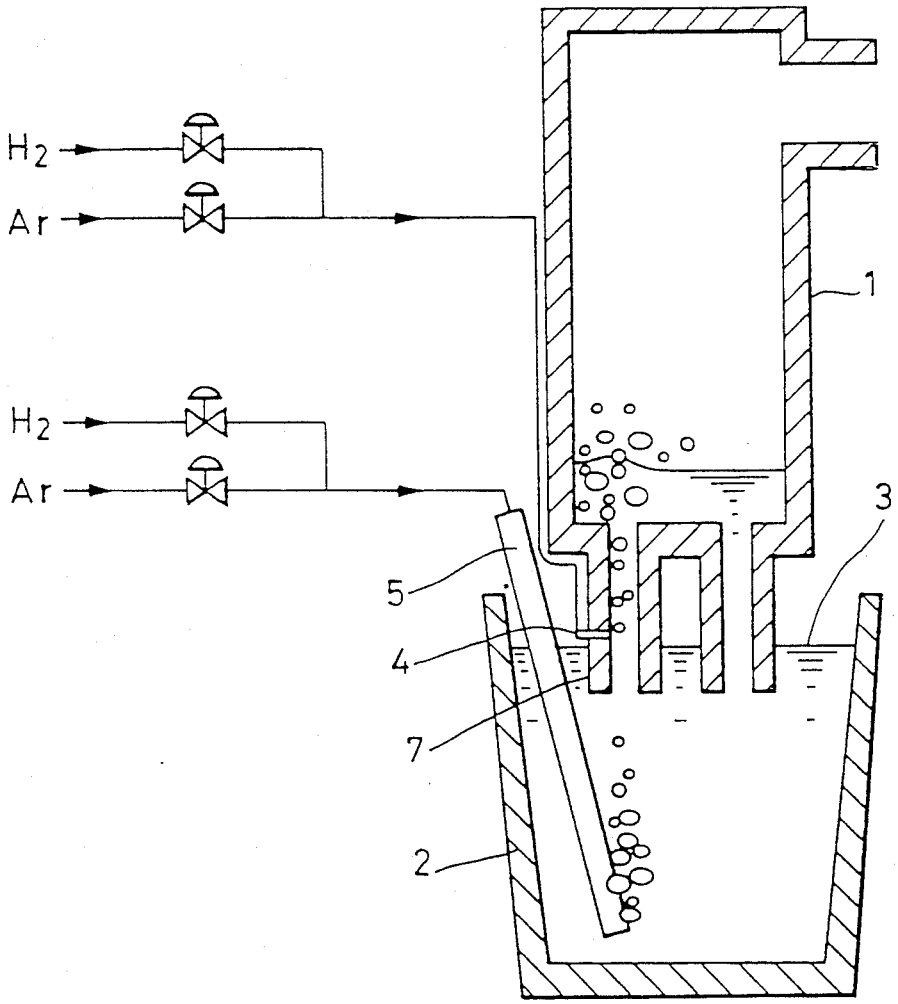
Figure 3:
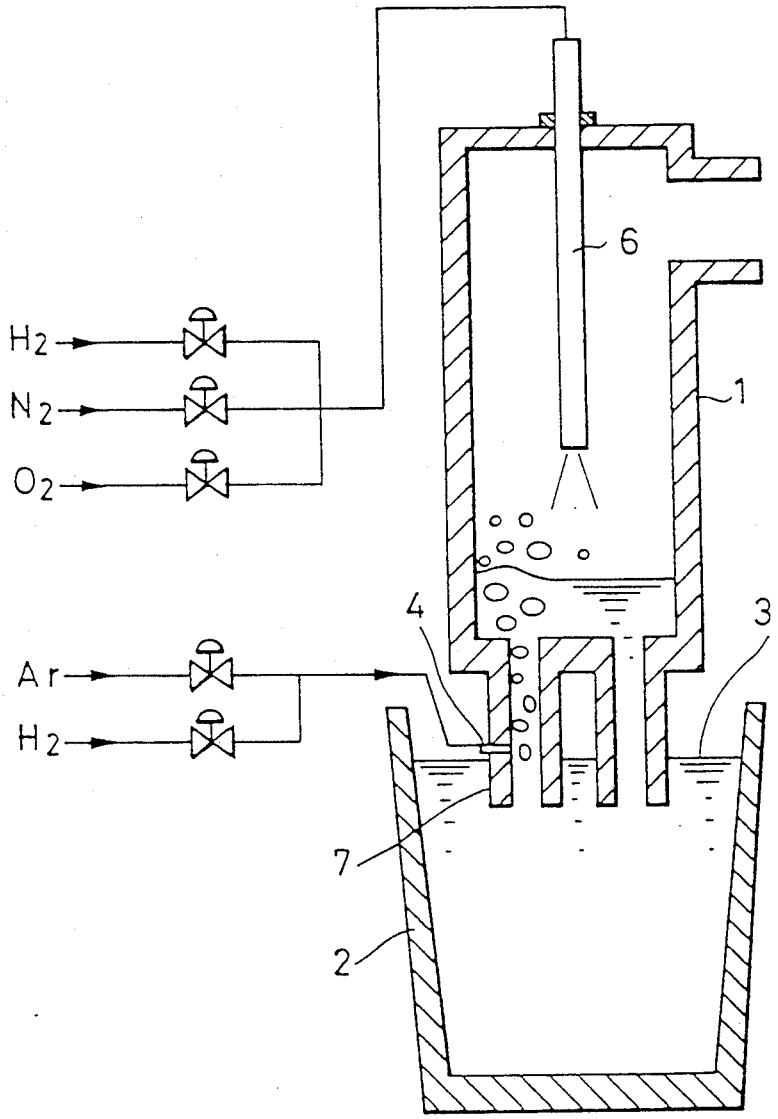

When an RH degasser is used as the degassing system in the method of the present invention, it is critical to use a suitable hydrogen supplying means which can supply, without difficulty, the required amount of hydrogen into the vacuum chamber directly or indirectly through the molten steel. For instance, it is possible to use blowing means such as, for example, (a) a recirculation gas tuyere 4 (see FIG. 1) provided in the wall of the up-leg 7, (b) an injection lance 5 (see FIG. 2) which is immersed in the molten steel in the ladle such that the introduced gas can move into the up-leg 7, or (c) a vertically movable top-blowing lance 6 (see FIG. 3) which may be of water-cooled type and which is situated above the surface of the molten steel in the vacuum chamber 1.

It is also possible to use a gas blowing tuyere provided on the side wall of the chamber, or a porous plug provided on the bottom of the ladle, as the means for supplying hydrogen.

Obviously, the time required for dissolving the hydrogen can be shortened by suitably combining two or more of these blowing means.

Continuation of supply of hydrogen during final decarburization following the addition of hydrogen is effective in prolonging the period of high hydrogen content and, hence, contributes to promotion of decarburization. Efficiency of dissolution of hydrogen, however, is extremely low during the period of final decarburization. It is therefore advisable that the continuation of addition of hydrogen be conducted by a suitable means which can maximize the distance of ascent of bubbles of hydrogen in the molten steel so as to ensure dissolution and which is easy to operate. When an RH degasser is used as the degassing system, continued addition of hydrogen is possible to some extent, without impairing the operation of the plant, by supplying hydrogen at a suitable rate through, for example, the recirculation gas tuyere 4 in the up-leg 7 shown in FIG. 1 and/or the injection lance 5 immersed in the molten steel shown in FIG. 2. By suitably combining two or more of the described hydrogen supplying means, it is possible to increase the dissolution of hydrogen so as to promote the decarburization.

The addition of hydrogen is effected by introduction of hydrogen-containing substance such as a hydrogen-containing gas. Water, steam, aluminum hydroxide, magnesium hydroxide and calcium hydroxide can be used equally well as they dissociate hydrogen to cause dissolution of hydrogen into the molten steel.

EXAMPLES

Examples of the method of the present invention, carried out by employing a 250-ton scale RH degasser, are shown below.

A non-deoxidized steel produced by a converter and having a carbon content of about 350 ppm and an oxygen content of about 450 ppm was subjected to decarburization conducted by the above-mentioned degasser.

Results of Examples 1 to 3 and Comparative Examples 1 and 2 are shown in Table 1.

In Example 1, Ar gas was blown at a rate of 2.0 $Nm^3$/min from a recirculating gas tuyere 4 in the vacuum chamber 1, followed by an ordinary decarburization which was conducted for 12 minutes. Then, some of the six stages of evacuation ejector were stopped to set the pressure inside the vacuum chamber to 30 Torr, and $H_2$ and Ar gases were blown for 3 minutes at rates of 6.0 $Nm^3$/min and 1.0 $Nm^3$/min, respectively, through the recirculation gas tuyere 4 in the up-leg 7 of the RH degasser shown in FIG. 1, thus adding hydrogen. As a result, the hydrogen content was increased from about 1 ppm to about 7 ppm. Subsequently, the above-mentioned ejector was started to operate its full power and, while the addition of $H_2$ gas was terminated addition of Ar gas through the tuyere 4 was continued at a rate of 2.0 $Nm^3$/min, thereby effecting final decarburization. The carbon content at the moment immediately before the start of the final decarburization was about 25 ppm in terms of mean value. After the re-start of the ejector, the pressure inside the vacuum chamber was lowered to less than 2 Torr in 1 minute. The carbon content after completion of the final decarburization was about 8 ppm as a mean value, while the mean value of the hydrogen content was about 3 ppm after completion of the final decarburization. An Al deoxidation treatment was conducted for 5 minutes following the final decarburization.

In Example 2, ordinary decarburization treatment was conducted for 12 minutes as in Example 1. In this case, the addition of hydrogen was conducted for 3 minutes and the final decarburization was conducted for 5 minutes. The period of the Al treatment was 5 minutes. In Example 2, however, the final decarburization was conducted under the supply of $H_2$ gas at a rate of 1.0 $Nm^3$/min through an% injection lance 5 (see FIG. 2) immersed beneath the up-leg 7 of the RH vacuum chamber. In addition, during the final decarburization, $H_2$ gas and Ar gas were supplied at rates of 2.5 $Nm^3$/min and 1.5 $Nm^3$/min, respectively, through the recirculation gas tuyere 4 in the up-leg 7. Thus, addition of hydrogen was continued throughout the period of the final decarburization. Mean values of the carbon content and hydrogen content in the molten steel before the final decarburization were about 25 ppm and about 7 ppm, respectively, while the mean values of the carbon content and hydrogen content in the molten steel after the final decarburization were about 6 ppm and about 4.5 ppm, respectively.

In Example 3, ordinary decarburization was conducted for 12 minutes as in Example 1. In this case, however, addition of hydrogen was conducted for 3 minutes after the internal pressure in the vacuum chamber was elevated to 30 Torr. Then, the ejector was fully operated to lower the internal pressure and the final decarburization was conducted for 5 minutes followed by Al deoxidation treatment which also was conducted for 5 minutes. In Example, $H_2$ gas and Ar gas were introduced at rates of 2.5 $Nm^3$/min and 1.5 $Nm^3$/min, respectively, through the recirculation gas tuyere 4 in the up-leg 7. At the same time, $H_2$ gas was blown onto the surface of the molten steel at a rate of 10 $Nm^3$/min through a water-cooled top-blow lance which had a single laval-type nozzle directed vertically downward and which was lowered to a level 2.5 m above the surface of the molten steel. During the final decarburization, the supply of $H_2$ gas and Ar gas at rates of 2.5 $Nm^3$/min and 1.5 $Nm^3$/min, respectively, was maintained through the tuyere 4, while the top blow lance was elevated to terminate blowing of $H_2$ gas. Mean values of the carbon content and hydrogen content in the molten steel before the final decarburization were about 25 ppm and about 7 ppm, respectively, while the mean values of the carbon content and hydrogen content in the molten steel after the final decarburization were about 7 ppm and about 3.8 ppm, respectively.

Comparative Example 1 employed the same RH degasser as that used in Example 1. In this case, Al deoxidation treatment was conducted for 5 minutes immediately after the ordinary decarburization process being conducted for 20 minutes. Thus, hydrogen was not added in this case. The mean value of the carbon content after completion of the decarburization was 17 ppm.

Comparative Example 2 also employed the same RH degasser as that used in Example 1. In this case, following 5 minutes of ordinary decarburization treatment, decarburization was executed for 15 minutes under the supply of hydrogen gas. Al deoxidation treatment was then conducted for 5 minutes. The addition of hydrogen during the decarburization was effected through the recirculation gas tuyere 4 in the up-leg 7 at a rate of 6.0 $Nm^3$/min, together with Ar gas supplied through the same tuyere at a rate of 1.0 $Nm^3$/min. Throughout the period of decarburization, the ejector was operated at its full power so that the internal pressure in the vacuum chamber was not elevated during the decarburization. In this case, mean values of the carbon content and the hydrogen content were about 12 ppm and about 3.5 ppm, respectively.

The mean values of the carbon content and standard deviations of the described Examples and Comparative Examples are shown in Table 1. It will be seen that very low carbon contents less than 10 ppm were obtained in short time in all the Examples 1 to 3 and that the fluctuation of the final carbon content is also small in these Examples.

TABLE 1

| | Total decarburization time (min) | Mean Value of C content after decarburization | Standard deviation of C content (ppm) | Mean value of H content at 15 min after process start* | Total quantity of $H_2$ ($Nm^3$) |
|---|---|---|---|---|---|
| Example 1 | 20 | 8.1 | 0.9 | 7.3 | 18 |
| Example 2 | 20 | 6.3 | 1.1 | 7.1 | 35.5 |
| Example 3 | 20 | 7.1 | 1.0 | 7.4 | 50 |
| Comp. Exmpl. 1 | 20 | 16.9 | 2.2 | 0.8 | 0 |
| Comp. Exmpl. 2 | 20 | 11.6 | 1.8 | 3.5 | 105 |

*just before the final decarburization

As will be understood from the foregoing description, according to the present invention, it is possible to quickly produce an ultra-low-carbon steel having a carbon content of not more than 10 ppm, with a high degree of stability, on an industrial scale. Furthermore, the method of the present invention does not contain any factor which would impede safe operation of the plant, such as damaging of the equipment by deposition of splashed particles of molten steel, extraordinary wear of refractories, and so forth. The method of the present invention, therefore, can easily be carried out with existing equipment if only the gas supply line of the equipment is modified to enable supply of hydrogen under the specified conditions.

It will thus be understood that the present invention offers various industrial advantages.

Although the invention has been described through its specific form, it is to be understood that the described Examples are only illustrative and various changes and modifications may be imparted thereto without departing from the scope of the invention which is limited solely by the appended claims.

What is claimed is:

1. A method of producing an ultra-low-carbon for producing sheet steel by using a vacuum degasser on a molten steel, comprising the steps of:

conducting vacuum decarburization to attain a predetermined level of carbon content in said molten steel by progressively reducing the pressure in said vacuum degasser;

adding hydrogen which is dissolved in said molten steel while said pressure is temporarily elevated to 20 Torr or above; and conducting final decarburization by reducing said pressure to 2 Torr or below.

2. A method of producing an ultra-low-carbon steel according to claim 1, wherein the addition of hydrogen is effected after the carbon content of said molten steel is reduced to 25 ppm or below.

3. A method of producing an ultra-low-carbon steel according to claims 1 and 2, wherein the addition of hydrogen is effected to meet the following conditions:

$$[H] \geqq \{([C]-[C]\text{final})/5\}+4$$

wherein [H] represents the hydrogen content (ppm) in said molten steel in the state after the addition of hydrogen, [C] represents the carbon content (ppm) in said molten steel in the state after the addition of hydrogen, and [C]final represents the final carbon content (ppm) to be obtained.

4. A method of producing an ultra-low-carbon steel according to claims 1 and 3, wherein hydrogen is added also during the execution of the final decarburization.

5. A method of producing an ultra-low-carbon steel according to claims 1 and 4, wherein the addition of hydrogen is effected by supplying a hydrogen-containing substance to the surface of the molten steel in said vacuum degasser.

6. A method of producing an ultra-low-carbon steel according to claim 5, wherein said hydrogen-containing substance includes at least one of hydrogen gas, water, steam, calcium hydroxide, aluminum hydroxide and magnesium hydroxide.

7. A method of producing an ultra-low-carbon steel according to claims 1 and 6, wherein an RH degasser is used as said vacuum degasser.

8. A method of producing an ultra-low-carbon steel according to claim 2, wherein hydrogen is added also during the execution of the final decarburization.

9. A method of producing an ultra-low-carbon steel according to claim 3, wherein hydrogen is added also during the execution of the final decarburization.

10. A method of producing an ultra-low-carbon steel according to claim 4, wherein the addition of hydrogen is effected by supplying a hydrogen-containing substance to the surface of the molten steel in said vacuum degasser.

* * * * *